United States Patent [19]

Garcia

[11] Patent Number: 4,483,416

[45] Date of Patent: Nov. 20, 1984

[54] HEIGHT ADJUSTABLE ROOF ENGAGING ATTACHMENT FOR LADDERS

[76] Inventor: Eduardo L. Garcia, 1108 W. 8th Pl., Yuma, Ariz. 85364

[21] Appl. No.: 559,465

[22] Filed: Dec. 8, 1983

[51] Int. Cl.[3] ..... E06C 7/48

[52] U.S. Cl. ..... 182/107; 182/206; 182/214

[58] Field of Search ..... 182/206, 214, 93, 107, 182/108

[56] References Cited

U.S. PATENT DOCUMENTS

| | | | |
|---|---|---|---|
| 480,160 | 8/1892 | Adams | 182/214 |
| 659,814 | 10/1900 | Frizell | 182/206 |
| 800,896 | 10/1905 | Biehler | 182/214 |
| 1,015,123 | 1/1912 | Bauer | 182/214 |
| 1,684,269 | 9/1928 | Hebner | 182/214 |
| 2,232,414 | 2/1941 | Swann | 182/206 |
| 2,295,908 | 9/1942 | Marriner | 182/206 |
| 2,778,556 | 1/1957 | Johnson | 182/206 |
| 3,476,212 | 11/1969 | Eakins | 182/103 |
| 3,603,431 | 9/1971 | Nameche | 182/206 |
| 4,311,209 | 1/1982 | Primerano | 182/206 |

FOREIGN PATENT DOCUMENTS 76846 8/1894 Fed. Rep. of Germany ..... 182/206

*Primary Examiner*—Reinaldo P. Machado

*Attorney, Agent, or Firm*—Harvey B. Jacobson

[57] ABSTRACT

A ladder including upstanding opposite side rails and vertically spaced rungs extending and mounted between the side rails is provided. A pair of screw shafts extend along and are journalled from the side rails and elongated guides are mounted from and extend along the upper end portions of the side rails. A pair of followers are guidingly engaged with the guides for movement therealong and the screw shafts are threadedly engaged with the followers. The lower ends of the shafts include structure for inputing rotary torque thereto and the followers include laterally outwardly projecting arm portions disposed generally normal to a plane containing side rails of the ladder. The arm portions include underside downwardly projecting teeth spaced therealong and the inner base ends of the arms are pivotally mounted from the followers for angular displacement of the arms between outwardly projecting operational positions and inwardly retracted positions disposed closely adjacent, generally paralleling and projecting downwardly along the screw shafts.

8 Claims, 6 Drawing Figures

FIG. 1
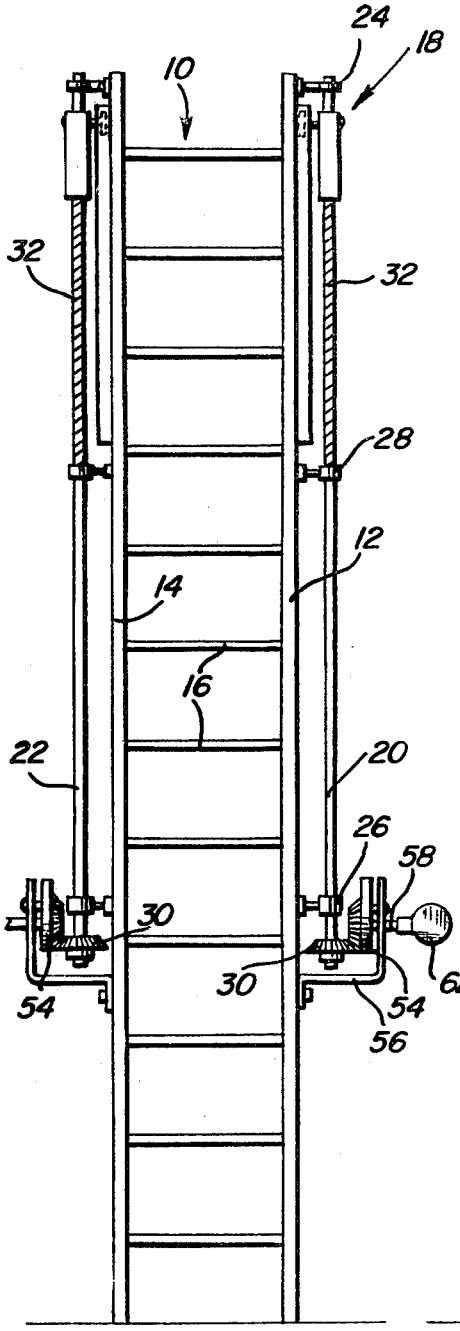
FIG. 2
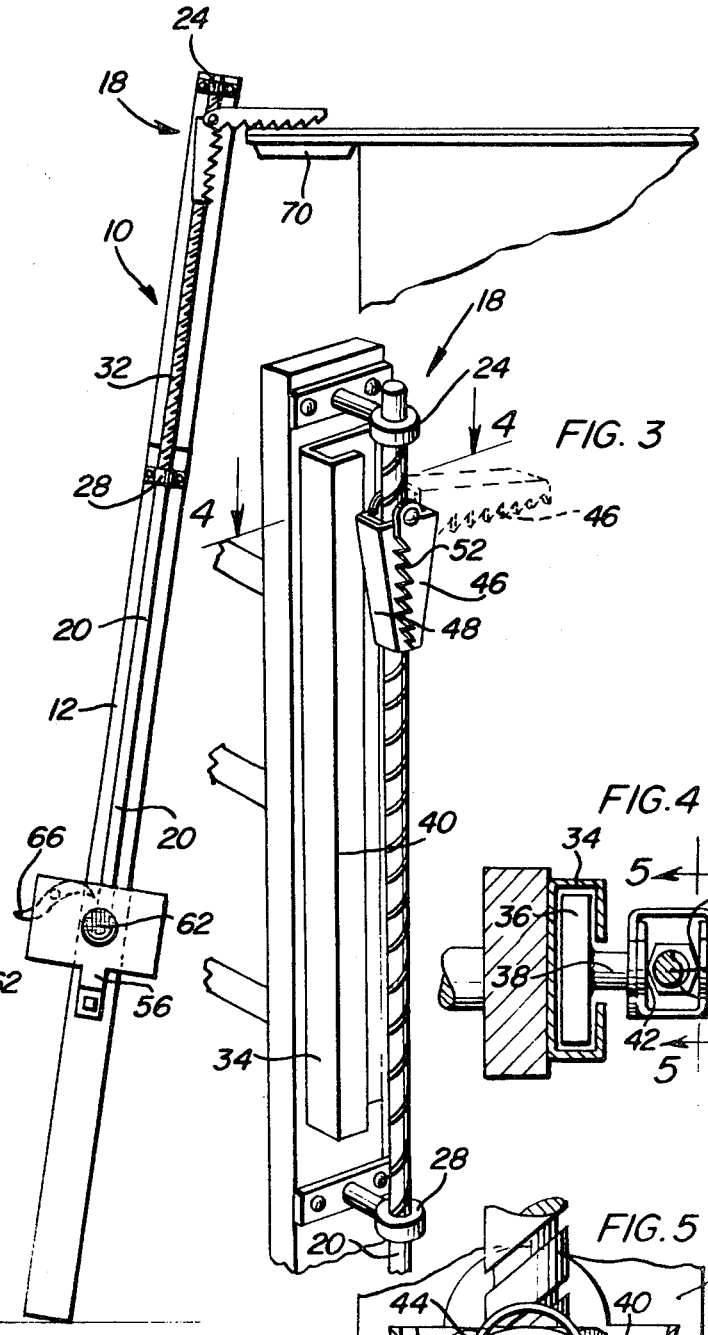
FIG. 3
FIG. 4
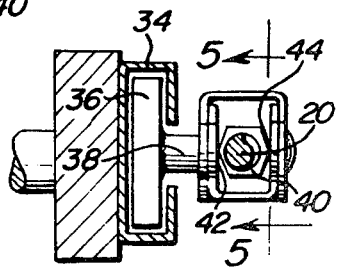
FIG. 5
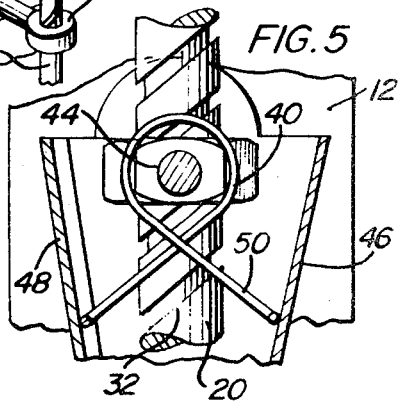
FIG. 6
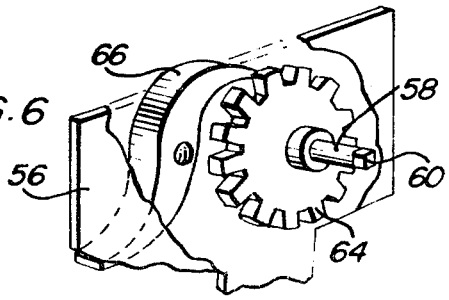

HEIGHT ADJUSTABLE ROOF ENGAGING ATTACHMENT FOR LADDERS

BACKGROUND OF THE INVENTION

Various forms of ladders and ladder attachments heretofore have been provided to enable the upper end of an inclined ladder to frictionally engage and be more securely supported from an object against which the upper end of the ladder is leaned. However, many of these ladder attachments interfere with normal use of the ladder when the attachments are not to be used and are not particularly well adapted for use in various working environments. Accordingly, a need exists for an improved form of ladder attachment capable of frictionally gripping an object against which the associated ladder is leaned and constructed in a manner whereby the attachment may be held in a retracted position so as not to interfere with operation of the ladder when the need for such an attachment is non-existent.

Examples of various different forms of ladder supporting attachments including some of the general structural and operational features of the instant invention are disclosed in U.S. Pat. Nos. 480,160, 800,896, 1,015,123, 1,684,269, 3,476,212 and 3,603,431.

BRIEF DESCRIPTION OF THE INVENTION

The ladder attachment of the instant invention includes a pair of screw shafts journalled from remote outer sides of the side rails of a ladder and a pair of elongated guides mounted from and extending along the remote outer sides of the ladder side rails. A pair of followers are threadedly engaged with the screw shafts and slidingly supported from the guides for movement therealong and the lower ends of the screw shafts have structure operatively associated therewith wherein rotary torque input may be applied to the screw shafts for rotating the same in opposite directions. The followers include toothed arm portions pivotally supported therefrom which may be swung between retracted positions extending downwardly along corresponding screw shafts and extended positions disposed substantially normal to a plane containing the side rails of the ladder and projecting outwardly of one side of the ladder.

Each of the followers includes a pair of arm portions each which may be swung to an extended position projecting outwardly of a corresponding side of the ladder and each arm is toothed for frictional engagement with a structure against which the associated ladder is leaned. Further, the arms may be swung to retracted positions closely paralleling and extending downwardly along the screw shafts and spring structure is operatively connected between the arms yieldingly biasing the latter toward their retracted positions.

The main object of this invention is to provide an improved ladder attachment which will enable the upper end portion of a ladder to more tightly frictionally grip a support structure against which the ladder is leaned.

Another object of this invention is to provide a ladder attachment in accordance with the preceding object and mounted on an associated ladder for adjustable positioning therealong.

Still another object of this invention is to provide a ladder attachment including a pair of outwardly projecting toothed arms supported adjacent the side rails of a ladder and wherein each of the arms is independently adjustable along the ladder relative to the other arm.

Yet another object of this invention is to provide a ladder attachment in accordance with the preceding objects and wherein the outwardly projecting arms of the attachment may be swung to retracted positions closely paralleling and extending along the side rails of the ladder.

Another object of this invention is to provide a ladder attachment which may be readily mounted upon existing ladders as well as incorporated in the manufacture of new ladders.

A final object of this invention to be specifically enumerated herein is to provide a ladder attachment in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front elevational view of a ladder equipped with the attachment of the instant invention;

FIG. 2 is a side elevational view of the ladder illustrated in FIG. 1 and with the upper end of the ladder supported from a roof edge by the attachment of the instant invention;

FIG. 3 is an enlarged fragmentary perspective view of the upper end portion of the near side of the ladder illustrated in FIG. 2;

FIG. 4 is an enlarged horizontal sectional view taken substantially upon the plane indicated by the section line 4-4 of FIG. 3;

FIG. 5 is a further enlarged vertical sectional view taken substantially upon the plane indicated by the section line 5-5 of FIG. 4; and FIG. 6 is a fragmentary perspective view of one of the latch structures by which the associated screw shaft may be releasably latched in adjusted rotated position.

DETAILED DESCRIPTION OF THE INVENTION

Referring now more specifically to the drawings the numeral 10 generally designates a conventional form of ladder including a pair of generally parallel upstanding opposite side rails 12 and 14 between which a plurality of vertically spaced horizontal rungs 16 extend and are secured.

The attachment of the instant invention is referred to in general by the reference numeral 18 and includes a pair of screw shafts 20 and 22 extending along and journalled from remote sides of the side rails 12 and 14 by upper, lower and intermediate journals 24, 26 and 28, respectively. The screw shafts 20 and 22 include bevel gears 30 on their lower end portions and the upper end portions are externally threaded as at 32 and are of high pitch.

The attachment 18 further includes a pair of elongated upstanding channel-shaped guides 34 secured to the remote sides of the side rails 12 and 14 and extending therealong between corresponding journals 24 and 28. Each of the guides 34 guidingly supports a follower 36 therefrom and each follower 36 includes an outwardly projecting shank 38 which projects through the slot 40 defined by the corresponding guide 34. The outer end portion of the shank 38 supports a nut 40 on a diametrically reduced portion 42 of the shank 38 with the portion 42 extending generally radially of the nut 40. The side of the nut remote from the portion 42 includes a generally radial stub shaft 44 and the upper threaded end portion 32 of the corresponding screw shaft 20 is threaded through the nut. A pair of elongated arms 46 and 48 are provided and are generally channel-shaped in cross section. Each pair of arms 46 and 48 includes base end portions which are pivotally supported from the corresponding portion 42 as well as the corresponding stub shaft 44 and a butterfly spring 50 is operatively connected between the arms 44 and 48 and yieldingly biases the ladder toward retracted positions extending downwardly along and generally paralleling the corresponding screw shaft 20. However, each of the arms 46 and 48 may have its free end swung upwardly so that the arm is disposed generally normal to the medial plane of the ladder 10 and projects outwardly of the corresponding side thereof, note the phantom line position of the arm 46 in FIG. 3.

The arms 46 and 48 include longitudinally spaced teeth 52 which face downwardly when the arms 46 and 48 are in their extended operative positions and each bevel gear 30 is meshed with a drive gear 54 journalled from a support bracket 56 mounted from the corresponding side rail. Each drive gear 54 is carried by a shaft 58 journalled through the bracket 56 and including a non-circular end portion 63 with which a torque input knob 62 is removably engaged. Each shaft 58 includes a toothed wheel 64 on the side of the bracket 56 remote from the knob 62 and with which a latch or stop dog 66 pivoted from the bracket 56 is engageable to retain the shaft 58 in adjusted angularly displaced positions.

In operation, the knob 62 may be engaged with either shaft 58 and the corresponding dog 66 may be released in order that rotation of the knob 62 will effect rotation of the corresponding screw shaft and vertical adjustment of the associated follower 36. When the follower 36 has been adjusted as desired, one of the corresponding arms 46 and 48 may be manually swung to the extended position thereof illustrated in phantom lines in FIG. 3 of the drawings for engagement with the support structure 70 against which the upper end of the ladder 10 is leaned. After both of the arms 46 have been engaged with the structure 70, final vertical adjustment of the followers 36 may be effected, if desired in order to ensure tight frictional engagement of the arms of the attachment 18 with the structure 70. Of course, the followers 36 may be independently vertically adjusted relative to the ladder side rails. Accordingly, the arms of the attachment may be frictionally engaged with an inclined portion of the structure 70.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a ladder including upstanding opposite side rails and vertically spaced rungs extending and mounted between said side rails, a pair of screw shafts extending along and journalled from said side rails, elongated guides mounted from and extending along the upper end portions of said side rails, a pair of followers guidingly engaged with said guides for movement therealong and with which said screw shafts are threadingly engaged, rotary torque input means for applying rotary input torque to the lower end portions of said screw shaft, said followers including laterally outwardly projecting arm portions supported therefrom and projecting outwardly from a side ladder facing outwardly of one side of a plane containing said side rails.

2. The ladder of claim 1 wherein said arm portions project outwardly of said one ladder side along paths disposed generally normal to said plane.

3. The ladder of claim 2 wherein said arm portions include longitudinally extending undersides having longitudinally spaced downwardly projecting teeth thereon.

4. The ladder of claim 1 wherein each of said followers includes a pair of oppositely outwardly projecting arm portions.

5. The ladder of claim 4 wherein said arm portions project outwardly of said one ladder side along paths disposed generally normal to said plane.

6. The ladder of claim 1 wherein said arm portions include base and free ends, means mounting said base ends from said followers for angular displacement of said arm portions relative thereto about axes paralleling said rungs and for movement of said arm portions between operative outwardly projecting positions and retracted positions closely paralleling and extending downwardly along said screw shafts.

7. The ladder of claim 6 wherein said arm portions include longitudinally extending undersides having longitudinally spaced downwardly projecting teeth thereon.

8. The ladder of claim 1 wherein said screw shafts include high pitch threads with which said followers are threadingly engaged.

* * * * *